US006029292A

United States Patent [19]

Leiferman et al.

[11] Patent Number: 6,029,292

[45] Date of Patent: Feb. 29, 2000

[54] HAND WASHING DEVICE

[76] Inventors: Gerald J. Leiferman; Mary Leiferman, both of 926 S. Isabella Rd., Mount Pleasant, Mich. 48858

[21] Appl. No.: 09/252,108

[22] Filed: Feb. 18, 1999

[51] Int. Cl.[7] ..... A47K 3/022

[52] U.S. Cl. ..... 4/621; 4/623; 4/615; 4/606; 401/7; 401/6; 251/354; 137/801; 15/104.92

[58] Field of Search ..... 4/621, 622, 604, 4/605, 606, 615, 661, 675, 676, 677, 678, 623; 251/354; 137/801; 15/104.92, 222; 401/6, 7

[56] References Cited

U.S. PATENT DOCUMENTS

| | | | |
|---|---|---|---|
| 836,181 | 11/1906 | Cray | 4/615 |
| 2,061,219 | 11/1936 | Wright | 401/7 |
| 5,092,560 | 3/1992 | Chen | 4/623 |

FOREIGN PATENT DOCUMENTS

| | | | |
|---|---|---|---|
| 734635 | 10/1932 | France | 251/354 |
| 362376 | 8/1938 | Italy | 251/354 |
| 392 | 10/1852 | United Kingdom | 4/606 |

*Primary Examiner*—Steven O. Douglas
*Assistant Examiner*—Khoa D. Huynh

[57] ABSTRACT

A hand washing device for helping handicapped people with only one hand and people with one hand in a cast wash the free hand. The hand washing device includes a scrubbing member that is adapted to be coupled to a faucet. The scrubbing member is adapted for being rubbed by a hand of a user for cleaning the hand. The scrubbing member has a water reservoir formed inside of it. The water reservoir is in fluid communication with the faucet. The scrubbing member has a plurality of apertures that extend through it and provides openings into the water reservoir of the scrubbing member. The apertures are adapted to permit passage of water through them.

18 Claims, 3 Drawing Sheets

HAND WASHING DEVICE

BACKGROUND OF THE INVENTION

1. Field of the Invention

The present invention relates to washing devices and more particularly pertains to a new hand washing device for helping handicapped people with only one hand and people with one hand in a cast wash the free hand.

2. Description of the Prior Art

The use of washing devices is known in the prior art. More specifically, washing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,061,219; U.S. Pat. No. 5,522,411; U.S. Pat. No. 4,696,593; U.S. Pat. No. 1,990,030; U.S. Pat. No. Des. 268,967; and U.S. Pat. No. 2,019,705.

While these devices fulfill their respective, particular objectives and requirements, the aforementioned patents do not disclose a new hand washing device. The inventive device includes a scrubbing member that is adapted to be coupled to a faucet. The scrubbing member is adapted for being rubbed by a hand of a user for cleaning the hand. The scrubbing member has a water reservoir formed inside of it. The water reservoir is in fluid communication with the faucet. The scrubbing member has a plurality of apertures that extend through it and provides openings into the water reservoir of the scrubbing member. The apertures are adapted to permit passage of water through them.

In these respects, the hand washing device according to the present invention substantially departs from the conventional concepts and designs of the prior art, and in so doing provides an apparatus primarily developed for the purpose of helping handicapped people with only one hand and people with one hand in a cast wash the free hand.

SUMMARY OF THE INVENTION

In view of the foregoing disadvantages inherent in the known types of washing devices now present in the prior art, the present invention provides a new hand washing device construction wherein the same can be utilized for helping handicapped people with only one hand and people with one hand in a cast wash the free hand.

The general purpose of the present invention, which will be described subsequently in greater detail, is to provide a new hand washing device apparatus and method which has many of the advantages of the washing devices mentioned heretofore and many novel features that result in a new hand washing device which is not anticipated, rendered obvious, suggested, or even implied by any of the prior art washing devices, either alone or in any combination thereof.

To attain this, the present invention generally comprises a scrubbing member that is adapted to be coupled to a faucet. The scrubbing member is adapted for being rubbed by a hand of a user for cleaning the hand. The scrubbing member has a water reservoir formed inside of it. The water reservoir is in fluid communication with the faucet. The scrubbing member has a plurality of apertures that extend through it and provides openings into the water reservoir of the scrubbing member. The apertures are adapted to permit passage of water through them.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hand washing device apparatus and method which has many of the advantages of the washing devices mentioned heretofore and many novel features that result in a new hand washing device which is not anticipated, rendered obvious, suggested, or even implied by any of the prior art washing devices, either alone or in any combination thereof.

It is another object of the present invention to provide a new hand washing device which may be easily and efficiently manufactured and marketed.

It is a further object of the present invention to provide a new hand washing device which is of a durable and reliable construction.

An even further object of the present invention is to provide a new hand washing device which is susceptible of a low cost of manufacture with regard to both materials and labor, and which accordingly is then susceptible of low prices of sale to the consuming public, thereby making such hand washing device economically available to the buying public.

Still yet another object of the present invention is to provide a new hand washing device which provides in the apparatuses and methods of the prior art some of the advantages thereof, while simultaneously overcoming some of the disadvantages normally associated therewith.

Still another object of the present invention is to provide a new hand washing device for helping handicapped people with only one hand and people with one hand in a cast wash the free hand.

Yet another object of the present invention is to provide a new hand washing device which includes a scrubbing member that is adapted to be coupled to a faucet. The scrubbing member is adapted for being rubbed by a hand of a user for cleaning the hand. The scrubbing member has a water reservoir formed inside of it. The water reservoir is in fluid communication with the faucet. The scrubbing member has a plurality of apertures that extend through it and provides openings into the water reservoir of the scrubbing member. The apertures are adapted to permit passage of water through them.

Still yet another object of the present invention is to provide a new hand washing device that helps prevent the spread of germs and disease by helping a user better wash his or her hand or hands.

Even still another object of the present invention is to provide a new hand washing device that may resemble a hand so that the cleaning effect of rubbing two hands together is produced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
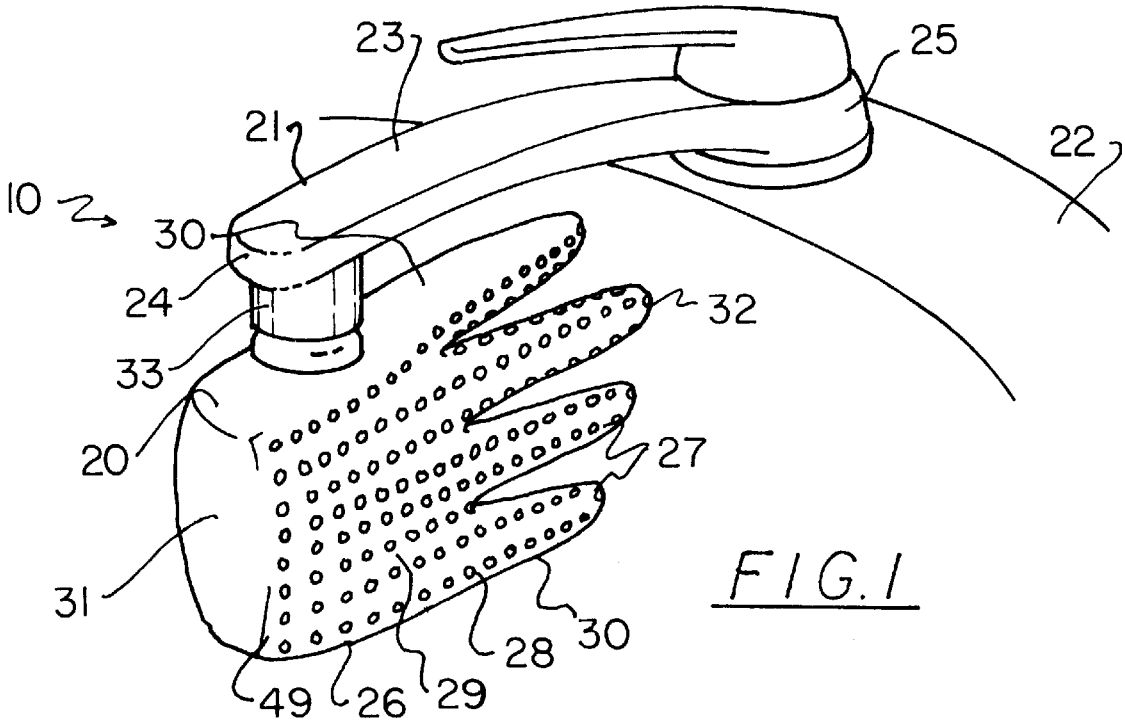
FIG. 1 is a schematic perspective view of a new hand washing device according to the present invention.

With reference now to the drawings, and in particular to FIGS. 1 through 5 thereof, a new hand washing device embodying the principles and concepts of the present invention and generally designated by the reference numeral 10 will be described.

As best illustrated in FIGS. 1 through 5, the hand washing device 10 generally comprises a scrubbing member that is adapted to be coupled to a faucet. The scrubbing member is adapted for being rubbed by a hand of a user for cleaning the hand. The scrubbing member has a water reservoir formed inside of it. The water reservoir is in fluid communication with the faucet. The scrubbing member has a plurality of apertures that extend through it and provide openings into the water reservoir of the scrubbing member. The apertures are adapted to permit passage of water through them.

In more detail, a first scrubbing member 20, illustrated in FIG. 1, is coupled to a first faucet 21 of a first sink basin 22. The first faucet has a spout 23 extending from the first sink basin. The spout has proximal and distal ends 24,25.

Preferably, the first scrubbing member is generally hand shaped and has a palm portion 26 and a plurality of elongate generally cylindrical finger portions 27 extending outwardly from the palm portion in a direction towards the distal end of the spout. More preferably, the palm portion and the finger portions each have a generally annular transverse cross sections such that a water reservoir is formed in the first scrubbing member. The water reservoir is in fluid communication with the first faucet.

Ideally, the finger portions are spaced apart to permit insertion of fingers of the hand of a user between the finger portions. This simulates rubbing the fingers of two hands together to clean the inner sides of the fingers.

The palm portion and each of the finger portions of the first scrubbing member have a plurality of apertures 28 extending through them that provide openings into the water reservoir of the first scrubbing member. The apertures are adapted for permitting passage of water therethrough to wet and rinse the user's hand.

The first scrubbing member has opposed sidewalls 29, a pair of lateral ends 30, and a back end 31 positioned opposite the finger portions. A length of the first scrubbing member is defined between an outermost fingertip 32 (seen as the second fingertip from the first faucet on FIG. 1) and the back end of the first scrubbing member. The preferred length of the first scrubbing member is between about 4 and 7 inches, ideally about 5½ inches.

A width of the first scrubbing member is defined between the sidewalls of the first scrubbing member. The preferred width of the first scrubbing member is between about 1 and 2½ inches, ideally about 2 inches.

A height of the first scrubbing member is defined between the lateral ends of the palm portion of the first scrubbing member. The preferred height of the first scrubbing member is between about 3 and 5 inches, ideally about 4 inches.

Figure 3:
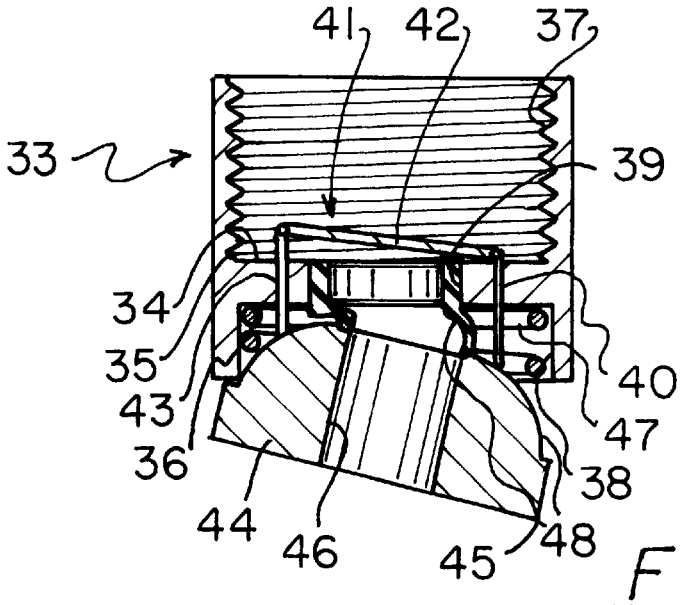
FIG. 3 is a schematic cross sectional view of the present invention taken from line 3—3 of FIG. 2.

Preferably, as shown in FIG. 3, the first scrubbing member has a valved coupling member 33 coupled to it that is adapted for coupling to the proximal end of the spout. The valved coupling member comprises an annular ring 34 that has first and second ends 35,36 and an axis extending between the ends.

The valved coupling member has a generally cylindrical threaded engaging portion 37 that extends from the first end of the annular ring and is adapted for threaded coupling to the spout.

The valved coupling member has a generally cylindrical spring receiving portion 38 extending from the second end of the annular ring. The annular ring has a first hole 39 extending centrally therethrough and a pair of second holes 40 extending through it between its first and second ends.

The valved coupling member has a spring valve assembly 41. The spring valve assembly includes a valve plate 42 positioned adjacent the first end of the annular ring. The valve plate opens and closes the first hole of the annular ring. A pair of arms 43 are pivotally coupled to the valve plate and extend through the second holes of the annular ring. An annular pivoting member 44 is pivotally coupled to a free end of each of the arms and coupled to the first scrubbing member. A deformable trough 45 is coupled to an inner surface of the first hole of the annular ring and is coupled to an upper opening into a lumen 46 through the pivoting member to keep the water contained in the trough though the pivoting member is pivoting. A spring 47 biases the pivoting member away from the annular ring to keep the first hole closed.

Figure 2:
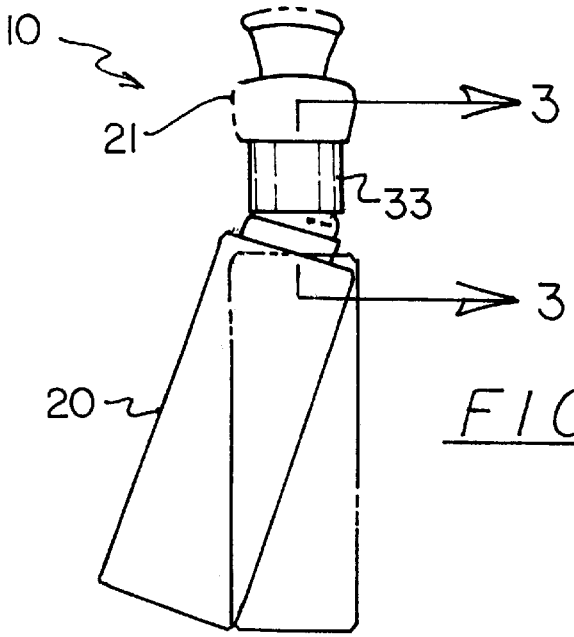
FIG. 2 is a schematic side view of a valve assembly of the present invention.

Pivoting of the pivoting member with respect to the axis of the annular ring lifts at least one of the arms thereby lifting the valve plate such that the first hole of the annular ring is opened so that water can flow through it. The pivoting member is pivoted by moving the first scrubbing portion from a resting position, in which the valve plate is in a closed orientation, in any direction away from the resting position. FIG. 2 shows the first scrubbing portion in a position away from the resting position, with the resting position being shown in shadow lines.

Ideally, an upper portion 48 of an outer surface of the pivoting member tapers together towards the annular ring to permit more the valved coupling member to have a shorter vertical profile.

Preferably, the first scrubbing member comprises a resilient material such as plastic or metal so that pushing on the first scrubbing member pivots the pivoting member of the spring valve assembly to turn the water on and a rough cover 49 covering the resilient material to provide slight abrasiveness to help the cleaning of the hand.

A second faucet 55 has a spout 56 extending from the first sink basin. The spout has proximal and distal ends.

Figure 4:
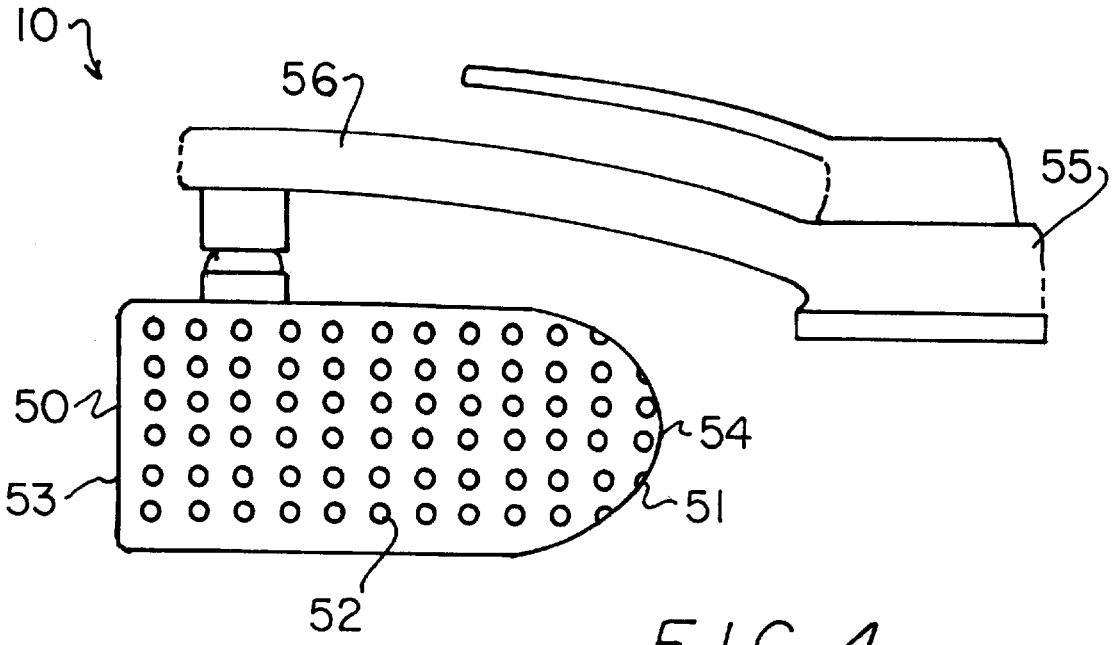
FIG. 4 is a schematic side view of an alternate embodiment of the present invention.

A second scrubbing member 50, illustrated in FIG. 4, is coupled to the proximal end of the spout of the second faucet. The second scrubbing member is also adapted to be rubbed by a hand of a user for cleaning the hand.

The second scrubbing member is generally rectangular and has a curved end 51 extending outwardly in a direction towards the distal end of the spout of the second faucet. The second scrubbing member has a generally annular transverse cross sections such that a water reservoir is formed in the second scrubbing member. The water reservoir is in fluid communication with the second faucet.

The second scrubbing member has a plurality of apertures 52 extending through it which provide openings into the water reservoir of the second scrubbing member. The apertures are adapted for permitting passage of water through them.

Ideally, the second scrubbing member has the same general dimensions as the first scrubbing member, with the length being taken between the back end 53 and the outermost tip 54 of the curved end of the second scrubbing member.

A third faucet 60 has a spout 61 extending from a second sink basin 62. The spout has proximal and distal ends 63. The second sink basin has a sensor 65 adapted for detecting placement of an object such as a hand under the third faucet. Preferably, the sensor senses motion or heat and is of a type known in the art.

The third faucet has an electronic valve (not shown) of a type known in the art and commonly used in public restrooms for selectively opening and closing the third faucet. The electronic valve is in electrical communication with the sensor. The electronic valve opens the third faucet when an object is detected under the third faucet and closes the third faucet when no object is detected under the third faucet.

Figure 5:
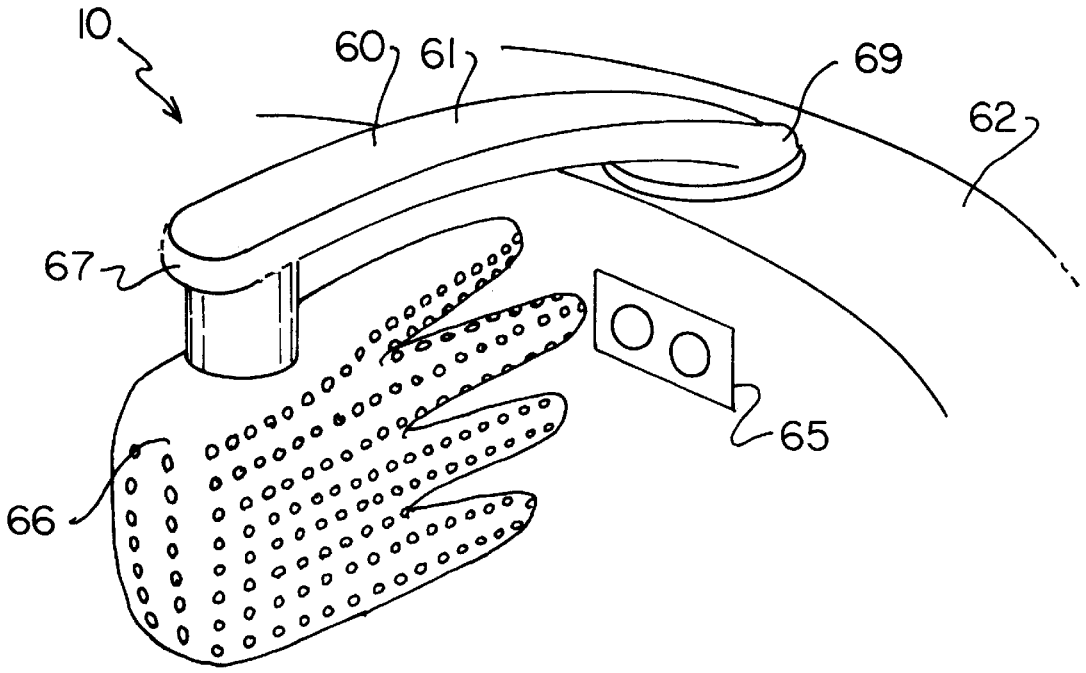
FIG. 5 is a schematic perspective view of a second alternate embodiment of the present invention.

A third scrubbing member 66, illustrated in FIG. 5, is coupled to the third faucet and is adapted to be rubbed by a hand of a user for cleaning the hand. Preferably, the third scrubbing member is constructed substantially as described above in the description of the first scrubbing member and has the same dimensions as the first scrubbing member.

It is to be noted that the description of the above embodiments is not intended to limit the elements and construction of an embodiment to that particular embodiment. Rather, each individual elements of any of the embodiments may be used in any combination with any of the elements of any or all of the embodiments.

To use the first scrubbing member in the configuration described above, a user places his or her hand against the first scrubbing member and pushes the first scrubbing member away from a resting position to open the valved coupling member so that water flows through the apertures of the first scrubbing member. The user rubs his or her hand back and forth against the first scrubbing member. The user's fingers are rubbed in between the finger portions of the first scrubbing member to clean the sides of the fingers. When done, the user quits pushing against the first scrubbing member to permit the spring to return it to the resting position such that the water stops flowing through the valved coupling member.

To use the second scrubbing member in the configuration described above, a user places his or her hand against the second scrubbing member and pushes the second scrubbing member away from a resting position to open the valved coupling member so that water flows through the apertures of the second scrubbing member. The user rubs his or her hand back and forth against the second scrubbing member. When done, the user quits pushing against the second scrubbing member to permit the spring to return it to the resting position such that the water stops flowing through the valved coupling member.

To use the third scrubbing member in the configuration described above, a user places his or her hand under the third faucet so that the sensor opens the electronic valve so that water flows through the apertures of the third scrubbing member. The user rubs his or her hand back and forth against the third scrubbing member. The user's fingers are rubbed in between the finger portions of the third scrubbing member to clean the sides of the fingers. When done, the user removes his hand from the second sink basin.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hand washing device for use with a faucet having a spout and for assisting in washing a hand, said hand washing device comprising:

a scrubbing member being adapted for being rubbed by a hand of a user for cleaning the hand;

said scrubbing member having a water reservoir formed therein, said water reservoir having an inlet adapted for being directly coupled to said spout of said faucet such that said scrubbing member is positioned adjacent to said spout, said water reservoir being in fluid communication with said faucet;

said scrubbing member having a plurality of apertures extending therethrough and providing openings into said water reservoir of said scrubbing member, said apertures being adapted for permitting passage of water therethrough;

wherein said scrubbing member is generally hand shaped and has a palm portion and a plurality of finger portions outwardly extending from said palm portion; and wherein said plurality of finger portions have at least a portion of said plurality of apertures disposed therein.

2. The hand washing device of claim 1, wherein said finger portions are spaced apart to permit insertion of fingers of the hand of a user between said finger portions.

3. The hand washing device of claim 1, wherein said scrubbing member has a valved coupling member adapted for coupling to said spout, said valved coupling member having a spring valve assembly for opening and closing said valved coupling member, said spring valve assembly restricting passage of water through said valve coupling member when said scrubbing member is in a resting position, said spring valve assembly permitting passage of water through said valve coupling member into said water reservoir of said scrubbing member when said scrubbing member is pivoted away from said resting position.

4. The hand washing device of claim 3, wherein said valved coupling member comprises an annular ring having first and second ends and an axis extending between said ends, said valved coupling member having a spring receiving portion extending from said second end of said annular ring, said annular ring having a first hole extending centrally therethrough and a pair of second holes extending therethrough between said first and second ends thereof, said spring valve assembly comprising a valve plate being positioned adjacent said first end of said annular ring for opening and closing said first hole of said annular ring, a pair of arms being pivotally coupled to said valve plate and extending through said second holes of said annular ring, an annular pivoting member being pivotally coupled to a free end of each of said arms, a deformable trough coupled to an inner surface of said first hole of said annular ring and coupled to an upper opening into a lumen through said annular pivoting member, and a spring for biasing said annular pivoting member away from said annular ring.

5. The hand washing device of claim 3, wherein said valved coupling member having a threaded engaging portion extending from said first end of said annular ring and adapted for threaded coupling to said spout.

6. The hand washing device of claim 4, wherein an upper portion of an outer surface of said annular pivoting member tapers together towards said annular ring.

7. The hand washing device of claim 1, wherein said scrubbing member comprising a resilient material and a rough cover covering said resilient material.

8. The hand washing device of claim 1, wherein said scrubbing member is generally rectangular and has a curved end extending outwardly in a direction towards a distal end of said spout.

9. A hand washing system for assisting in washing a hand, said hand washing device comprising:

a sink basin;

a faucet having a spout extending from said sink basin, said spout having proximal and distal ends;

a scrubbing member being coupled to said spout of said faucet such that said scrubbing member is positioned adjacent to said spout, said scrubbing member being adapted for being rubbed by a hand of a user for cleaning the hand;

said scrubbing member being generally hand shaped and having a palm portion and a plurality of elongate generally cylindrical finger portions extending outwardly from said palm portion, said palm portion and said finger portions each having a generally annular transverse cross sections such that a water reservoir is formed in said scrubbing member, said water reservoir being in fluid communication with said faucet;

said finger portions being spaced apart to permit insertion of fingers of the hand of a user between said finger portions;

said palm portion and each of said finger portions of said scrubbing member having a plurality of apertures extending therethrough and providing openings into said water reservoir of said scrubbing member, said apertures being adapted for permitting passage of water therethrough;

said scrubbing member having opposed sidewalls, a pair of lateral ends, and a back end positioned opposite said finger portions;

a length of said scrubbing member being defined between an outermost fingertip and said back end of said scrubbing member, said length of said first scrubbing member being between about 4 and 7 inches;

a width of said scrubbing member being defined between said sidewalls of said scrubbing member, said width of said scrubbing member being between about 1 and 2½ inches;

a height of said scrubbing member being defined between said lateral ends of said palm portion of said scrubbing member, said height of said scrubbing member being between about 3 and 5 inches;

said scrubbing member having a valved coupling member coupled thereto adapted for coupling to said proximal end of said spout, said valved coupling member comprising an annular ring having first and second ends and an axis extending between said ends;

said valved coupling member having a generally cylindrical threaded engaging portion extending from said first end of said annular ring and adapted for threaded coupling to said spout;

said valved coupling member having a generally cylindrical spring receiving portion extending from said second end of said annular ring;

said annular ring having a first hole extending centrally therethrough and a pair of second holes extending therethrough between said first and second ends thereof;

said valved coupling member having a spring valve assembly, said spring valve assembly comprising a valve plate being positioned adjacent said first end of said annular ring for opening and closing said first hole of said annular ring, a pair of arms being pivotally coupled to said valve plate and extending through said second holes of said annular ring, an annular pivoting member being pivotally coupled to a free end of each of said arms, a deformable trough coupled to an inner surface of said first hole of said annular ring and coupled to an upper opening into a lumen through said pivoting member, and a spring for biasing said pivoting member away from said annular ring;

wherein pivoting of said pivoting member with respect to said axis of said annular ring lifts at least one of said arms thereby lifting said valve plate such that said first hole of said annular ring is opened;

an upper portion of an outer surface of said pivoting member tapering together towards said annular ring;

said scrubbing member comprising a resilient material and a rough cover covering said resilient material;

said scrubbing member being generally rectangular and having a curved end extending outwardly in a direction towards said distal end of said spout of said faucet, said scrubbing member having a generally annular transverse cross sections such that a water reservoir is formed in said scrubbing member, said water reservoir being in fluid communication with said faucet;

said scrubbing member having a plurality of apertures extending therethrough and providing openings into said water reservoir of said scrubbing member, said apertures being adapted for permitting passage of water therethrough;

said sink basin having a sensor adapted for detecting placement of an object under said faucet;

said faucet having an electronic valve for selectively opening and closing said faucet, said electronic valve being in electrical communication with said sensor, said electronic valve opening said faucet when an object is detected under said faucet, said electronic valve closing said faucet when no object is detected under said faucet.

10. A band washing device for use with a faucet having a spout extending above a sink basin and for assisting in washing a hand, said hand washing device comprising:

a scrubbing member being adapted for being rubbed by a hand of a user for cleaning the hand;

said scrubbing member having a water reservoir formed therein, said water reservoir being in fluid communication with said faucet;

said scrubbing member having a plurality of apertures extending therethrough and providing openings into said water reservoir of said scrubbing member, said apertures being adapted for permitting passage of water therethrough; and wherein said water reservoir has an inlet adapted for being directly coupled to said spout of said faucet such that said scrubbing member is suspended above said sink basin and water expelled from said plurality of apertures is caught by said sink basin.

11. The hand washing device of claim 10, wherein said scrubbing member is generally hand shaped and has a palm portion and a plurality of finger portions outwardly extending from said palm portion.

12. The hand washing device of claim 11, wherein said finger portions are spaced apart to permit insertion of fingers of the hand of a user between said finger portions.

13. The hand washing device of claim 10, wherein said scrubbing member has a valved coupling member adapted for coupling to said spout, said valved coupling member having a spring valve assembly for opening and closing said valved coupling member, said spring valve assembly restricting passage of water through said valve coupling member when said scrubbing member is in a resting position, said spring valve assembly permitting passage of water through said valve coupling member into said water reservoir of said scrubbing member when said scrubbing member is pivoted away from said resting position.

14. The hand washing device of claim 13, wherein said valved coupling member comprises an annular ring having first and second ends and an axis extending between said ends, said valved coupling member having a spring receiving portion extending from said second end of said annular ring, said annular ring having a first hole extending centrally therethrough and a pair of second holes extending therethrough between said first and second ends thereof, said spring valve assembly comprising a valve plate being positioned adjacent said first end of said annular ring for opening and closing said first hole of said annular ring, a pair of arms being pivotally coupled to said valve plate and extending through said second holes of said annular ring, an annular pivoting member being pivotally coupled to a free end of each of said arms, a deformable trough coupled to an inner surface of said first hole of said annular ring and coupled to an upper opening into a lumen through said annular pivoting member, and a spring for biasing said annular pivoting member away from said annular ring.

15. The hand washing device of claim 13, wherein said valved coupling member having a threaded engaging portion extending from said first end of said annular ring and adapted for threaded coupling to said spout.

16. The hand washing device of claim 14, wherein an upper portion of an outer surface of said annular pivoting member tapers together towards said annular ring.

17. The hand washing device of claim 10, wherein said scrubbing member comprising a resilient material and a rough cover covering said resilient material.

18. The hand washing device of claim 10, wherein said scrubbing member is generally rectangular and has a curved end extending outwardly in a direction towards a distal end of said spout.

* * * * *